US006109821A

United States Patent [19]

Montalbano et al.

[11] Patent Number: 6,109,821

[45] Date of Patent: Aug. 29, 2000

[54] ROADWAY MARKER

[76] Inventors: Anthony A. Montalbano, 331-B Oak Hill Rd., Barrington, Ill. 60010; Sidney A. Heenan, 2424 Decook South Ct., Park Ridge, Ill. 60068; Loren M. Lundtveit, 38688 N. Magnolia Ave., Waukegan, Ill. 60087

[21] Appl. No.: 08/911,324

[22] Filed: Aug. 14, 1997

Related U.S. Application Data

[63] Continuation of application No. 08/586,343, Mar. 21, 1996, abandoned.

[51] Int. Cl.[7] ..... E01F 11/00

[52] U.S. Cl. ..... 404/15; 404/9; 116/63 R

[58] Field of Search ..... 116/63 P, 63 R; 404/9, 12, 14, 15, 16

[56] References Cited

U.S. PATENT DOCUMENTS

| | | | |
|---|---|---|---|
| 2,303,462 | 12/1942 | Horne . | |
| 3,332,327 | 7/1967 | Heenan . | |
| 3,392,639 | 7/1968 | Hennan et al. . | |
| 3,485,148 | 12/1969 | Heenan . | |
| 3,499,371 | 12/1966 | Jonnes et al. | 94/1.5 |
| 4,227,772 | 10/1980 | Heenan . | |
| 4,232,979 | 11/1980 | Johnson, Jr. et al. . | |
| 4,340,319 | 7/1982 | Johnson, Jr. et al. . | |
| 4,648,689 | 3/1987 | May | 350/105 |
| 4,990,024 | 2/1991 | Eigenmann . | |
| 5,078,538 | 1/1992 | Montalbano . | |
| 5,082,715 | 1/1992 | Lasch et al. . | |
| 5,120,154 | 6/1992 | Lasch et al. . | |
| 5,194,113 | 3/1993 | Lasch et al. . | |
| 5,338,129 | 8/1994 | Oden et al. . | |
| 5,340,231 | 8/1994 | Steere et al. . | |
| 5,352,158 | 10/1994 | Brodeur, Jr. | 472/92 |
| 5,357,879 | 10/1994 | Bailey | 116/209 |
| 5,392,728 | 2/1995 | Speer et al. | 116/63 |
| 5,403,115 | 4/1995 | Flader . | |
| 5,411,351 | 5/1995 | Lasch et al. . | |
| 5,425,596 | 6/1995 | Steere et al. . | |
| 5,449,244 | 9/1995 | Sandino | 404/14 |
| 5,470,170 | 11/1995 | Lindner | 404/9 |
| 5,513,924 | 5/1996 | Alghunaim . | |

*Primary Examiner*—Tamara L. Graysay
*Assistant Examiner*—Gary S. Hartmann

[57] ABSTRACT

A roadway marker comprises a solid body member having a lower generally planar surface configured to be adhered directly to a roadway surface. The marker is injection molded as a one-piece structure from a closed-cell foam thermoplastic material using a chemical blowing agent. The bottom surface of the body member may be formed with slight recesses or protrusions such that the entire bottom of the marker fills with adhesive when the marker is installed. Thus, maximum adhesive surface area is provided between the marker and the roadway surface. Further, the closed-cell foam construction creates a marker body which is strong, economical to mold and which does not shrink after molding.

10 Claims, 2 Drawing Sheets

ROADWAY MARKER

This is a continuation of application Ser. No. 08/586,343 filed on Mar. 21, 1996, now abandoned.

BACKGROUND OF THE INVENTION

1. Field of the Invention

The present invention relates generally to the construction of roadway markers and, more particularly, to roadway markers having enhanced pavement adherence capabilities when used with conventional adhesives while exhibiting exceptional strength and economy in manufacture.

2. Description of the Prior Art

Roadway markers have long been used to designate lanes of traffic and roadway centerlines to improve highway safety. Early forms of roadway markers were non-retroreflective and were constructed of a solid piece of ceramic material having a high gloss on its top surface to provide for a degree of specular reflection of incident light and afford a daytime visual indication of roadway lane configurations, for example. These ceramic markers had a generally granular, unglazed bottom surface to improve adhesion and typically were formed with bumped protrusions on their bottom surfaces to improve shear strength in conjunction with suitable adhesive materials.

Such markers were useful only for daytime delineation of lane lines. U.S. Pat. No. 3,332,327, assigned to the common assignee herein, describes a retroreflective marker for retroreflecting incident light from oncoming vehicle headlights, thus providing for exceptional highway marking during nighttime or other low light driving conditions. To provide support for the retroreflective thermoplastic shell and means for attachment to the road, such markers were filled with a thermosetting epoxy and, as with the ceramic daytime markers, were adhered to the road with epoxy adhesives. In early versions of these markers, the bottom surface of the epoxy fill was smooth and glossy; however, it was observed that adhesion of the epoxy filled markers was inferior to that of the ceramic markers and in order to improve adhesion, the bottom of the epoxy was sprinkled with sand to provide the sandpaper-like surface that is still being used today for potted type markers.

In a later version of retroreflective markers, the retroreflective element was molded separately and welded to a thermoplastic body having a waffle-like interior grid of internal cells in order to reduce considerably the amount of material used in manufacture, reduce otherwise prohibitive manufacturing cycles and avoid the undesirable shrinkage that would occur during the molding process if the body were to be molded as a solid piece. An example of such a marker is disclosed in U.S. Pat. No. D-267,933 issued Feb. 14, 1983. Such markers are installed by depositing a suitable adhesive, such as bitumen or epoxy, on either a roadway surface or the underside of the marker base so that the adhesive is sandwiched between the roadway surface and marker, and applying downward pressure to seat the marker in the adhesive. Of the two adhesives mentioned, bitumen has an advantage of rapid setup, enabling marker installation without closing the road to traffic. However, bitumen has greatly inferior adhesive strength compared with epoxy, particularly at elevated ambient temperature, and it was soon noted that the loss rate of waffle-bottom type markers installed with bitumen was, in some instances, much greater than the loss rate of waffle-bottom type markers installed with epoxy or the loss rate of potted markers installed with either adhesive. It is believed that the greater loss rate of the waffle-bottom marker when installed with bitumen is attributable to the adhesive being squeezed out from beneath the narrow cell walls and upward into the cells, thus leaving only a thin film of adhesive or no adhesive between the roadway surface and the downwardly facing surface portions of the marker base.

In order to improve bonding capability of conventional thermoplastic markers alternatives have been proposed to the open-cell narrow wall construction of the marker shell. In one such alternative, the narrow cell walls of the shell are thermally deformed after molding to have generally mushroomed bottom surfaces. This mushrooming of the cell walls serves not only to increase surface area of the cell walls for better bonding, it allows adhesive to flow upwardly into the associated cells and around the mushroomed surfaces of the walls thereby providing a positive mechanical interlocking of the marker to the adhesive. An example of such a marker construction is disclosed in U.S. Pat. No. 5,078,538 issued Jan. 7, 1992 and assigned to the common assignee herein.

While markers as just described improve over earlier construction, they are still not without disadvantages. Specifically, it has been found that markers having internal chambers sealed at their bottoms with adhesive experience pressure differentials between the ambient air pressure acting on the exposed marker shell and the air pressure internal to the chambers. Air pressure within the marker chambers increases notably, for example, if the marker is installed cold and then later is heated by elevated ambient temperatures. This effect of differential pressure reduces the hold-down force on the markers. For example, for a marker of the type manufactured by Stimsonite Corporation as model No. 66 having a cell grid area of approximately ten square inches, the marker will experience an upwardly directed force tending to remove it from the roadway surface of approximately seventeen pounds if the marker is installed at an ambient temperature of 50° F. and later experiences a typical warm weather pavement temperature of 110° F. It can be appreciated that at such an elevated temperature bitumen adhesive will have reduced bonding capability as well. For example, studies have shown that the slant shear strength of bitumen at 100° F. or 120° F. is respectively 15% and 8% of the shear strength at 70°; thus the lifting pressure of trapped air at increased temperatures and the reduced adhesive strength of bitumen at increased temperatures combine to cause a greater loss rate of the waffle-bottom marker adhered with bitumen.

In another alternative to early prior art waffle-like marker shell construction, enhanced surface bonding is achieved by essentially covering the open cell grid of the marker bottom with a perforated plate which is secured to the marker shell as by sonic welding, for example. This construction allows for the surface area of the marker bottom to be maximized while still using the lightweight waffle-like interior construction of the marker shell. An example of such construction is disclosed in co-pending application Ser. No. 08/487,250 filed Jun. 13, 1995 and assigned to the common assignee herein. While such marker construction is particularly effective against the effects of pressure differentials as heretofore described, the use of a grid covering plate adds to the cost of manufacture of the marker by requiring an added part and added steps in the production process.

Accordingly, it is desirable to provide a roadway marker which may readily be produced by known manufacturing techniques as a lightweight but strong and durable product. It is further desirable to provide such a marker which does not exhibit undesirable pressure differentials as would tend to dislodge the marker from the roadway surface under ambient temperature variations present during normal marker use. Still further, it is desirable to provide such a marker having a base surface area which is maximized such that the marker has enhanced adhering properties when installed with a preferred adhesive such as bitumen. Further, it is desirable to provide a marker which is economical to manufacture and exhibits superior quality in manufacture without extraordinary production methods.

SUMMARY OF THE INVENTION

The present invention overcomes the disadvantages of the prior art by providing a roadway marker comprising a solid body member having an upper generally convex surface and a lower generally planar surface, the lower planar surface being configured to be adhered directly to a roadway surface. The body member is injection molded as a one-piece structure from a closed-cell foam thermoplastic material using a chemical blowing agent. The lower surface of the body member may be formed with an array of recesses having a depth no greater than as to allow the recesses to completely fill, without voids, with a suitable adhesive such as bitumen. Thus, maximum adhesive surface area is provided between the lower body surface and the roadway surface. Further the closed cell foam construction creates a marker body which is strong, economical to mold and which does not shrink after molding.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
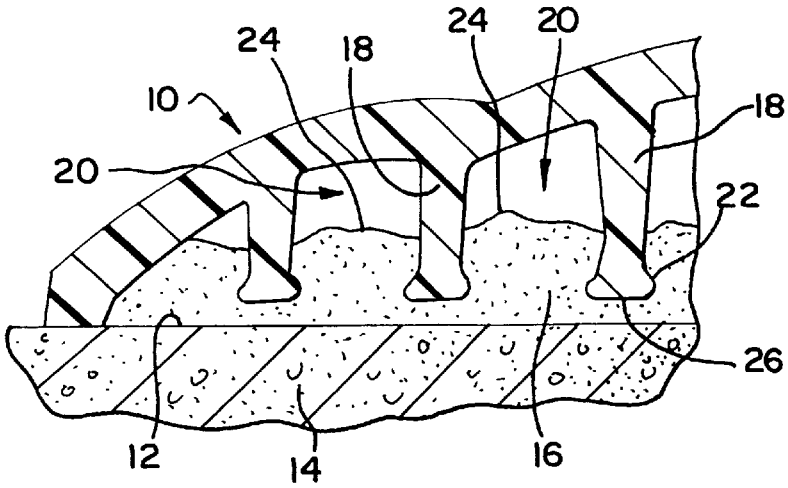
FIG. 1 (PRIOR ART)
FIG. 1 is a partial side cross-sectional view of a type of roadway marker known in the prior art.

Referring now to the drawings, and initially to FIG. 1, a roadway marker of a type constructed in accordance with the prior art is designated generally by the reference numeral 10. The marker 10 is shown as being installed on a surface 12 of a roadway pavement 14 with suitable adhesive 16. The marker 10 is typically injection molded from a suitable high impact thermoplastic. Internal to the marker 10 are a series of downwardly projecting ribs or walls 18 arranged in a honey-comb configuration defining waffle-like cells 20. This waffle-like construction has been preferred over a solid construction, for example, because less material is needed to mold the marker 10, and undesirable shrinkage as would distort the marker 10 after molding can be avoided. Also, the prohibitive molding time required to mold a part as a solid can be minimized. In this example of a prior art marker 10, the ribs 18 have been thermally deformed at their lower surfaces to have a mushroomed cross-section 22. By this configuration, adhesive 16 flows around and over the mushroomed surfaces 22 of the ribs 18 and thereby creates a mechanical bond between the roadway surface 12 and the marker 10. However, it can be appreciated from FIG. 1 that differential air pressure between ambient air pressure and the pressure within the cells 20 can reduce the hold-down force on the marker 10 as increased pressure within the cells 20 acts on upper surfaces 24 of the cured adhesive 16. Further, the bottoms 26 of the mushroomed surfaces 22 have relatively small surface areas. Therefore, the mechanical bond with the roadway surface 12 is somewhat limited.

Figure 2:
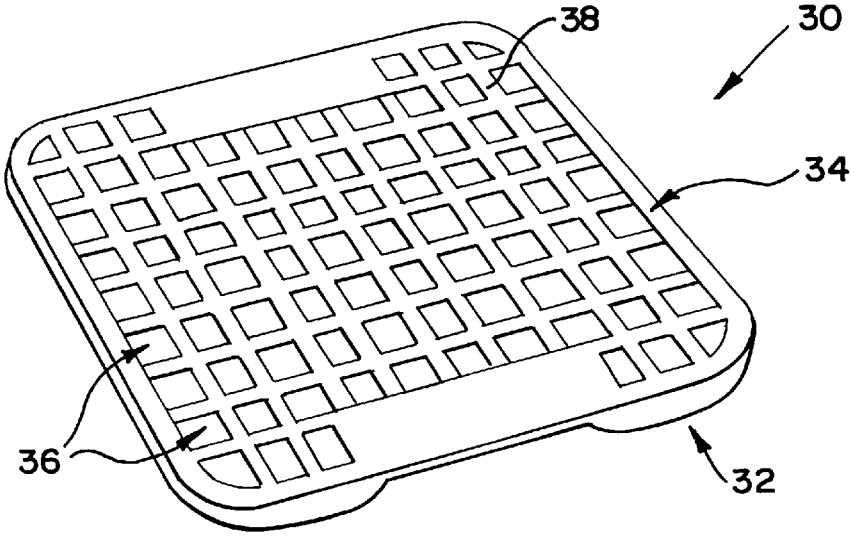
FIG. 2 is a bottom perspective view of a roadway marker body constructed in accordance with the principles of the present invention.
Figure 3:
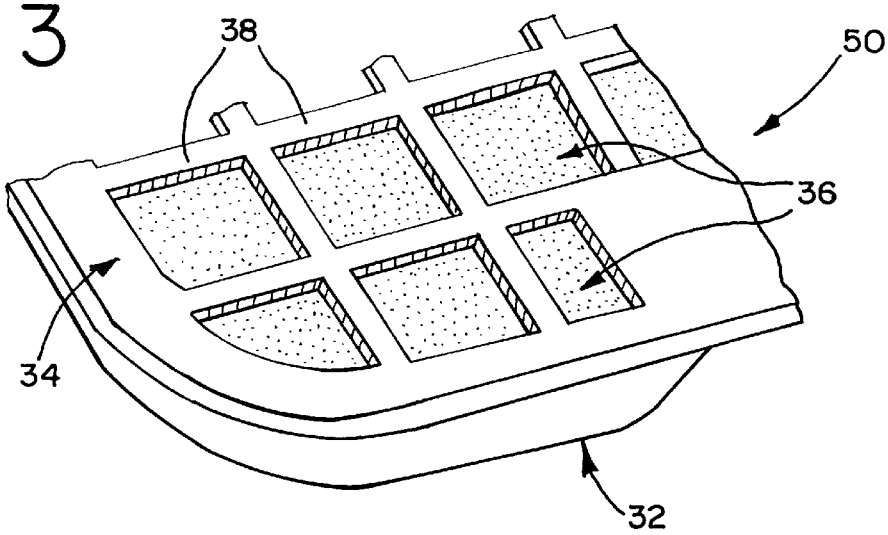
FIG. 3 is an enlarged fractional view of the marker body shown in FIG. 2.
Figure 4:
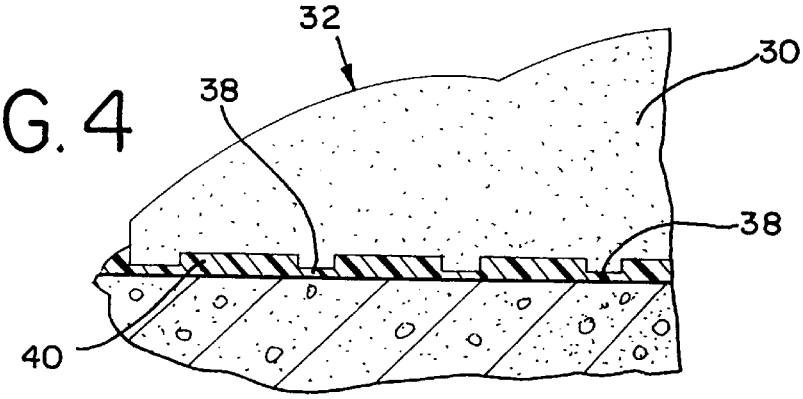
FIG. 4 is a fractional side view of the present marker body shown as installed on a roadway surface.

Turning now to FIGS. 2–4, a marker constructed in accordance with the principles of the invention is designated generally by the reference numeral 30 and is formed as a unitary, one-piece body member as will be described hereinafter in detail. In a manner well-known in the art, the marker 30 has a generally domed upper surface 32 which may be suitably adapted to support a retroreflective device if the marker 30 is to be used to designate roadway configurations during nighttime driving conditions. The bottom of the marker 30 is formed to define a generally planar surface 34.

In one preferred form of the invention the marker body 30 has a bottom surface 34 which is formed with an array of recesses 36 defined by walls or ribs 38. Moreover, and as best seen in FIG. 3, these recesses 36 unlike the prior art cells 20 of the above-described marker 10 have only a slight depth of preferably on the order of 0.020 inch. Moreover, the walls 38 are preferably on the order of one-eighth inch wide. By this configuration, and as best seen in FIG. 4, it has been found that a suitable adhesive 40 such as bitumen will flow into the recesses 36 as to completely fill the recesses 36 without air voids when the marker 30 is manually pressed into the adhesive 40 during installation on a roadway pavement 42 surface. Thus, the entire lower surface 34 of the marker body 30 is adhered to the pavement 42 and maximum bonding strength of the adhesive 40 is achieved. Further, the recesses 36 filled with adhesive 40 act to resist shear forces which would tend to dislodge the marker 30 from the pavement 42 during vehicle impact. Moreover, because the recesses 36 are completely filled with adhesive 40 there is no internal pressure within the marker 30 creating an upward force which would tend to dislodge the marker 30 from the pavement 42 at elevated ambient temperatures commonly present during hot weather conditions.

An important aspect of the invention is that the marker body 30 is preferably injection molded as a one piece, solid structure from a structural thermoplastic, closed-cell foam. In one preferred form of a temporary marker 30 the plastic is high impact polystyrene injected using a chemical blowing agent. A suitable blowing agent has been found to be a product sold under the trade name ACTIVEX 537 as manufactured by J. M. Hubar Corporation of Haure de Grace, Md. In other forms of permanent markers, the plastic may be thermoplastic polyurethane, polycarbonate, acrylonitrile butadiene styrene, or polyvinyl chloride. Using this construction it has been found, for example, that a marker 30 having the general overall configuration of the aforementioned Stimsonite Model No. 66 marker and using polystyrene, will have a fill-in molding time of only 26% greater than the Model No. 66 and a material weight increase of only 27%. However, the marker 30, will have a compressive strength which is 145% greater than that of the Model 66. Further, the marker body 30 will not shrink appreciably after molding and, thus, it will have a generally uniform quality, particularly of its lower planar surface 34 such that superior uniform adherence characteristics of the marker 30 are achieved. In an actual test installation, for example, using the marker 30 as just described, seventy-five markers 30 were installed using bitumen adhesive on an asphalt paved highway, along with seventy-five similarly installed Stimsonite Model No. 66 markers with thermally deformed bottoms, in an upper mid-west United States location. The collective markers were monitored over a period of two months during typical late summer weather conditions. After the two-month period, ten of the No. 66 markers had become dislocated as compared with only one of the present markers 30.

Figure 5:
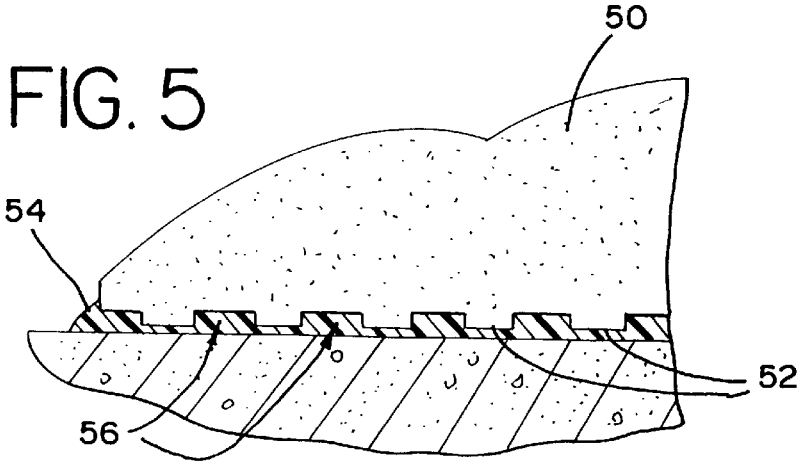
FIG. 5 is a fractional side view of a marker constructed in accordance with an alternative embodiment of the present invention and shown as installed on a roadway surface.

In another preferred form of the invention, and as illustrated in FIG. 5, a marker 50 may be constructed of a closed-cell foam as heretofore described. However, instead of having a bottom surface formed with recesses 36, the bottom may be formed with an array of protrusions or bosses 52 preferably having a projection height of on the order of 0.020 inch. The bosses 52 may have any one of several shapes, although a round disc-like shape is preferred. In such case, the diameter of the bosses may advantageously be on the order of 0.25 inch in diameter, separated by a typical maximum distance of one-quarter inch. As in the case of the marker 30, superior adhesion results are achieved with the marker 50 by virtue of the flow of adhesive 54 into spaces 56 formed between the bosses 32.

While the present invention has been described in connection with preferred embodiments thereof it will be apparent to those skilled in the art that many changes and modifications may be made without departing from the true spirit and scope of the present invention. Accordingly, it is intended by the appended claims to cover all such changes and modifications as come within the true spirit and scope of the invention.

What is claimed is:

1. A roadway marker comprising a body member having an upper generally convex surface and a lower generally planar surface, said planar surface being configured to be adhered directly to a roadway surface, said body member being injection molded as a solid, one-piece structure formed from a rigid closed-cell foam thermoplastic material.

2. The roadway marker of claim 1 wherein said body member is formed using a chemical blowing agent.

3. The roadway marker of claim 1 wherein said thermoplastic material is high impact polystyrene.

4. The roadway marker of claim 1 wherein said planar surface is formed with an array of recesses and said recesses have a depth no greater than as to allow said recesses to completely fill with an adhesive when said marker is installed on a roadway surface.

5. The roadway marker of claim 4 wherein said recesses have a depth of approximately 0.020 inch.

6. The roadway marker of claim 4 wherein said recesses are defined by an array of closed cell walls and said walls have a thickness of approximately one-eighth inch.

7. The roadway marker of claim 1 wherein said thermoplastic material is selected from the group consisting of polyurethane, polycarbonate, acrylonitrile-butadiene-styrene and polyvinyl chloride.

8. The roadway marker of claim 1 wherein said planar surface is formed with an array of projections defining spaces between adjacent projections and said spaces have a depth no greater than as to allow said spaces to completely fill with an adhesive when said marker is installed on a roadway surface.

9. The roadway marker of claim 8 wherein said spaces have a depth of approximately 0.020 inch.

10. The roadway marker of claim 8 wherein said projections are spaced from one another by approximately one-quarter inch.

* * * * *